US008047875B2

(12) United States Patent
Yamakami et al.

(10) Patent No.: US 8,047,875 B2
(45) Date of Patent: Nov. 1, 2011

(54) CONNECTOR DEVICE

(75) Inventors: Tohru Yamakami, Shinagawa (JP); Takeshi Okuyama, Shinagawa (JP); Tadashi Kumamoto, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 149 days.

(21) Appl. No.: 12/607,115

(22) Filed: Oct. 28, 2009

(65) Prior Publication Data

US 2010/0190385 A1 Jul. 29, 2010

(30) Foreign Application Priority Data

Jan. 28, 2009 (JP) ..... 2009-016442

(51) Int. Cl.
*H01R 24/00* (2011.01)

(52) U.S. Cl. ..... 439/660; 439/108

(58) Field of Classification Search ..... 439/676, 439/660, 700, 108
See application file for complete search history.

(56) References Cited

U.S. PATENT DOCUMENTS

| | | | | |
|---|---|---|---|---|
| 6,183,302 | B1 | 2/2001 | Daikuhara et al. | |
| 6,361,367 | B1 * | 3/2002 | Daikuhara et al. | 439/607.07 |
| 6,368,121 | B1 * | 4/2002 | Ueno et al. | 439/108 |
| 6,923,664 | B2 * | 8/2005 | Ito et al. | 439/108 |
| 6,942,525 | B2 * | 9/2005 | Olson et al. | 439/660 |
| 7,275,962 | B1 * | 10/2007 | Yamakami et al. | 439/620.21 |
| 7,438,565 | B2 * | 10/2008 | Hamazaki | 439/108 |
| 7,488,188 | B2 * | 2/2009 | Moriyama et al. | 439/108 |
| 7,824,224 | B2 * | 11/2010 | Su et al. | 439/629 |
| 2004/0242071 | A1 * | 12/2004 | Ito et al. | 439/608 |
| 2005/0048846 | A1 * | 3/2005 | Suzuki et al. | 439/660 |
| 2006/0281354 | A1 * | 12/2006 | Ngo et al. | 439/290 |
| 2007/0072457 | A1 * | 3/2007 | Hamazaki | 439/108 |

FOREIGN PATENT DOCUMENTS

JP 2000-068006 A 3/2000

* cited by examiner

*Primary Examiner* — Briggitte R Hammond
(74) *Attorney, Agent, or Firm* — IPUSA, PLLC

(57) ABSTRACT

A jack connector includes pairs of jack signal contacts and jack ground contacts arranged alternately, and a plug connector includes pairs of plug signal contacts and plug ground contacts arranged alternately. Respective contacts of each pair of jack signal contacts come into contact with respective contacts of each pair of plug signal contacts, and each jack ground contact comes into contact with each plug ground contact. In a first contact structure, each jack ground contact comes into contact with each plug ground contact at a first position, and in a second contact structure each jack ground contact comes into contact with each plug ground contact at a second position apart from the first position along an extending direction of the plug ground contact.

8 Claims, 14 Drawing Sheets

CONNECTOR DEVICE

CROSS-REFERENCE TO RELATED APPLICATIONS

This application is based upon and claims the benefit of priority of the prior Japanese Patent Application No. 2009-016442, filed on Jan. 28, 2009, the entire contents of which are incorporated herein by reference.

BACKGROUND OF THE INVENTION

1. Field of the Invention

The present invention relates to a connector device, and, in particular, to a connector apparatus including a jack connector for a balanced transmission system (differential transmission system) and a plug connector for a balanced transmission system (differential transmission system).

2. Description of the Related Art

As systems for data transmission, there are an ordinary transmission system (single-end system) and a balanced transmission system (differential transmission system). In the single-end system, a single electric wire is used for each data. In the balanced transmission system, a pair of electric wires are used for each item of data, a positive signal and a negative signal having the same amplitude and an opposite direction are transmitted simultaneously, and an electric potential difference between the positive and negative signals is used to transmit data. In the balanced transmission system, there is no influence from draft of a ground level, an advantage being that it is not likely to be influenced by noise in comparison to the ordinary transmission method, and thus, the balanced transmission system is used in many cases.

A connector is used to transmit data between two apparatuses. In a case where data is transmitted in such a balanced transmission system, a balanced transmission connector device having a structure such that a pair of transmission lines are provided for each item of data may be used. The balanced transmission connector device has a general configuration such that pairs of first and second signal contacts and sheet-shaped ground contacts are alternately arranged.

FIGS. 1A and 1B depict a portion of contacts included in a jack connector 10 and a plug connector 100 of a balanced transmission connector device in the related art.

In FIGS. 1A and 1B, X1-X2 directions denote row directions of an arrangement of contacts (width directions of the connectors), Z1-Z2 directions denote column directions of the arrangement of contacts (height directions of the connectors), and Y1-Y2 directions denote length directions of the connectors (depth directions of the connectors, or directions in which the connectors are inserted/removed therebetween).

The jack connector 10 is configured such that, sheet-shaped jack ground contacts 20 and pairs of first and second jack signal contacts 30, 40 are arranged thereon, and the jack connector 10 is mounted on a printed circuit board 200. Each of the jack ground contacts 20 has an upper arm part 22, a lower arm part 23 and a gulf part 24, and further, spring parts 25, 26 at an extending end of the jack ground contact 20.

The plug connector 100 is configured such that sheet-shaped plug ground contacts 120 and pairs of first and second plug signal contacts 130, 140 are arranged, an intermediate substrate 150 is connected with the plug ground contacts 120 and the first and second plug signal contacts 130, 140, and is provided to an end of a coaxial cable (not shown).

When the plug connector 100 is connected with the jack connector 10, as depicted in FIG. 1B, the first and second plug signal contacts 130, 140 in each pair come into contact with the first and second jack signal contacts 30, 40 in each pair, respectively, and each of the plug ground contacts 120 comes into contact with the spring parts 25, 26 of each of the jack ground contacts 20.

Because data signals transmitted by the balanced transmission connector 1 are radio frequency signals, the data signals are transmitted between the plug connector 100 and the jack connector 10 of the balanced transmission connector 1 which are connected together, while the data signals generate radio frequency ground currents in the plug ground contacts 120 and the jack ground contacts 20. Thus, the radio frequency ground currents flow through between the plug ground contacts 120 and the jack ground contacts 20.

The spring parts 25 and 26 of the jack ground contacts 20 provide returning paths for the radio frequency ground currents. The jack ground contacts 20 come into contact with the plug ground contacts 120 at almost extending ends of the spring parts 25 and 26, and therefore, so-called stubs are not formed. In contrast thereto, the plug ground contacts 120 have stubs 50 which are extending-side portions of the plug ground contacts 120 with respect to positions at which the spring parts 25 and 26 come into contact with the jack ground contacts 120. As can be seen from FIG. 1B, the positions at which the spring parts 25 and 26 come into contact with the jack ground contacts 120 are approximately the centers of the jack ground contacts 120 along the Y1-Y2 directions. Therefore, the stubs 50 have a length L1 which is relatively large.

The stubs 50 are such as to provide dead ends for the radio frequency ground currents, and thus, the radio frequency ground currents are reflected by the extending end of the stubs 50.

Patent Document: Japanese Laid-Open Patent Application No. 2000-068006

Recently, an information amount to be transmitted increases and a signal transmission rate is increased. Presently a transmission rate is on the order of around 2 Gbps, but a transmission rate is planned to be increased to the order of tens of Gbps in the next generation. When a signal is transmitted at a high transmission rate, a crosstalk characteristic, which is one of transmission characteristics of a balanced transmission connector device, may have to be improved, and for example, a crosstalk amount may have to be less than −30 dB, for the purpose of guaranteeing reliability in data transmission.

In FIG. 10, a graph line I depicts a crosstalk characteristic of a balanced transmission connector device 1 in the related art. As depicted in FIG. 10, in the graph line I, a crosstalk amount is not sufficiently reduced. This is because the above-mentioned stub 50 has a relatively large length L1.

Further, as depicted in FIG. 11, a graph line II, a crosstalk characteristic concerning resonance of the balanced transmission connector device 1 in the related art is such that, a crosstalk amount has a peak Q which occurs at a relatively low frequency.

It is noted that, in the above-mentioned crosstalk characteristic concerning resonance of the balanced transmission connector device 1 in the related art, in a case where data to be transmitted has a predetermined frequency, the ground contacts 20 and 120 resonate, radio frequency ground currents sharply increase, noise increases, the first and second signal contacts 30, 130, 40 and 140 are affected by the noise, and the crosstalk amount increases.

Therefore, in a case where a signal is transmitted at such a high transmission rate as tens of Gbps in near future, it may become difficult to guarantee reliability in data transmission.

SUMMARY OF THE INVENTION

The present invention has been devised in consideration of the above-mentioned situation, and an object of the present invention is to provide a connector device in which a crosstalk characteristic is improved, and transmission characteristics are improved.

According to the present invention, in order to achieve the above-mentioned object, a connector device includes a jack connector including a plurality of pairs of jack signal contacts and a plurality of jack ground contacts, wherein each pair of jack signal contacts of the plurality of pairs of jack signal contacts and each jack ground contact of the plurality of jack ground contacts are arranged alternately; and also includes a plug connector including a plurality of pairs of plug signal contacts and a plurality of plug ground contacts, wherein each pair of plug signal contacts of the plurality of pairs of plug signal contacts and each plug ground contact of the plurality of plug ground contacts are arranged alternately. Further, respective contacts of each pair of jack signal contacts come into contact with respective contacts of each pair of plug signal contacts, and each jack ground contact comes into contact with each plug ground contact, and the connector device has a first contact structure in which each jack ground contact comes into contact with each plug ground contact at a first position; and the connector device has a second contact structure in which each jack ground contact comes into contact with each plug ground contact at a second position apart from the first position along an extending direction of the plug ground contact.

According to the present invention, for the jack ground contacts and the plug ground contacts, because stubs are reduced in their lengths, or, more preferably, no stubs are included, an influence of the stubs is reduced or eliminated, and a crosstalk characteristic is improved.

DETAILED DESCRIPTION OF THE. PREFERRED EMBODIMENTS

Embodiments of the present invention will be described.

Embodiment 1

Figure 2B:
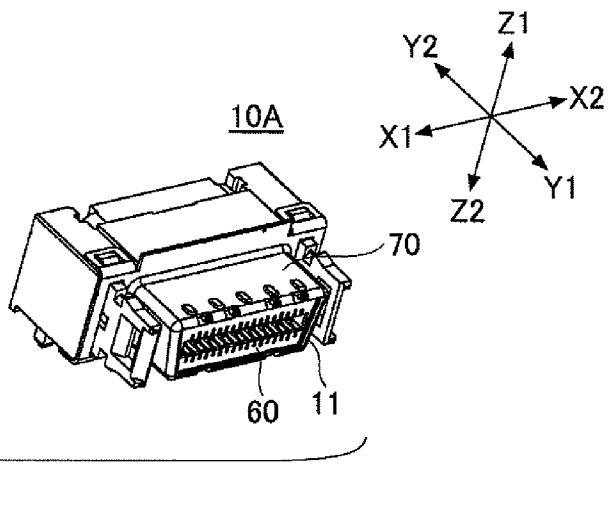
FIGS. 2A and 2B depict a perspective view of a jack connector and a plug connector of a balanced transmission connector device in an embodiment 1 of the present invention.
Figure 2A:
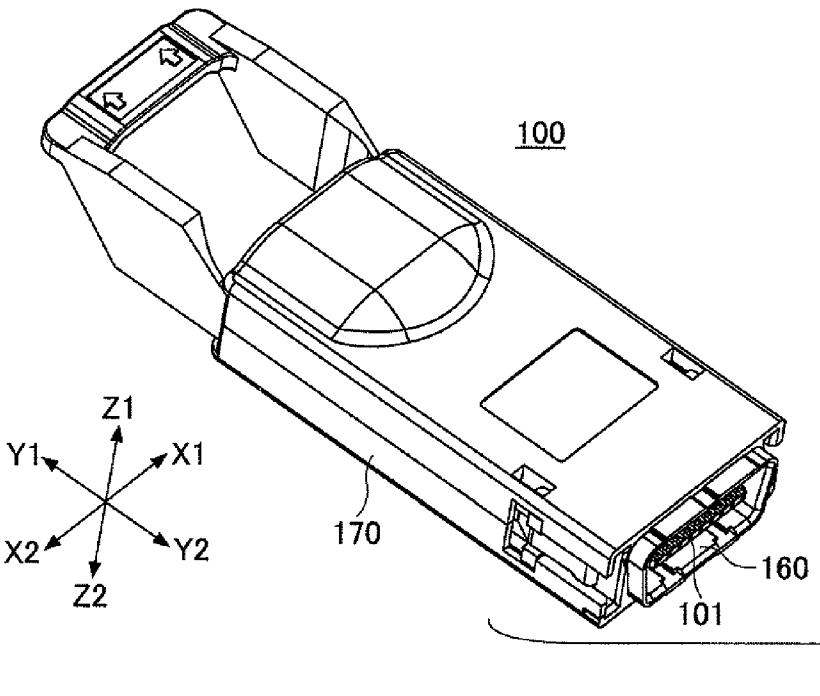
Figure 3:
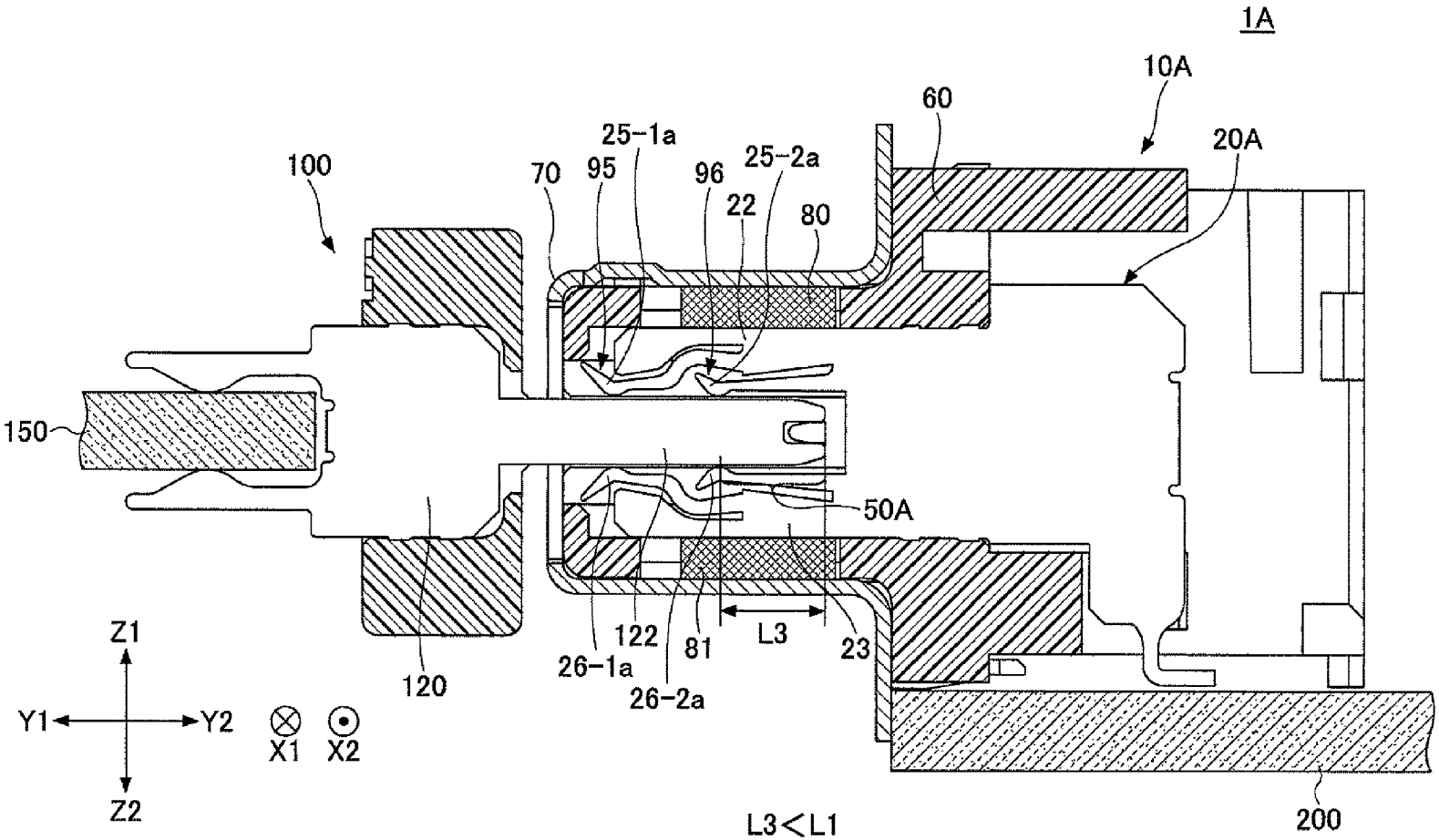
FIG. 3 depicts a longitudinal sectional view in a state where the plug connector is connected to the jack connector.

FIGS. 2A and 2B respectively depict a plug connector 100, acting as a male part having parts that stick out and fit into corresponding recesses of a female part, and a jack connector 10A acting as a female part having the recesses of a balanced transmission connector device 1A in an embodiment 1 of the present invention. FIG. 3 depicts a state in which the plug connector 100 is connected to the jack connector 10A.

Hereinafter, X1-X2 directions denote row directions of an arrangement of contacts of plug and jack connectors (width directions of the plug and jack connectors), Z1-Z2 directions denote column directions of the arrangement of contacts (height directions of the plug and jack connectors), and Y1-Y2 directions denote length directions of the plug and jack connectors (depth directions of the plug and jack connectors, or directions in which the plug and jack connectors are inserted/removed therebetween).

[Configuration of Plug Connector 100]

Figure 8:
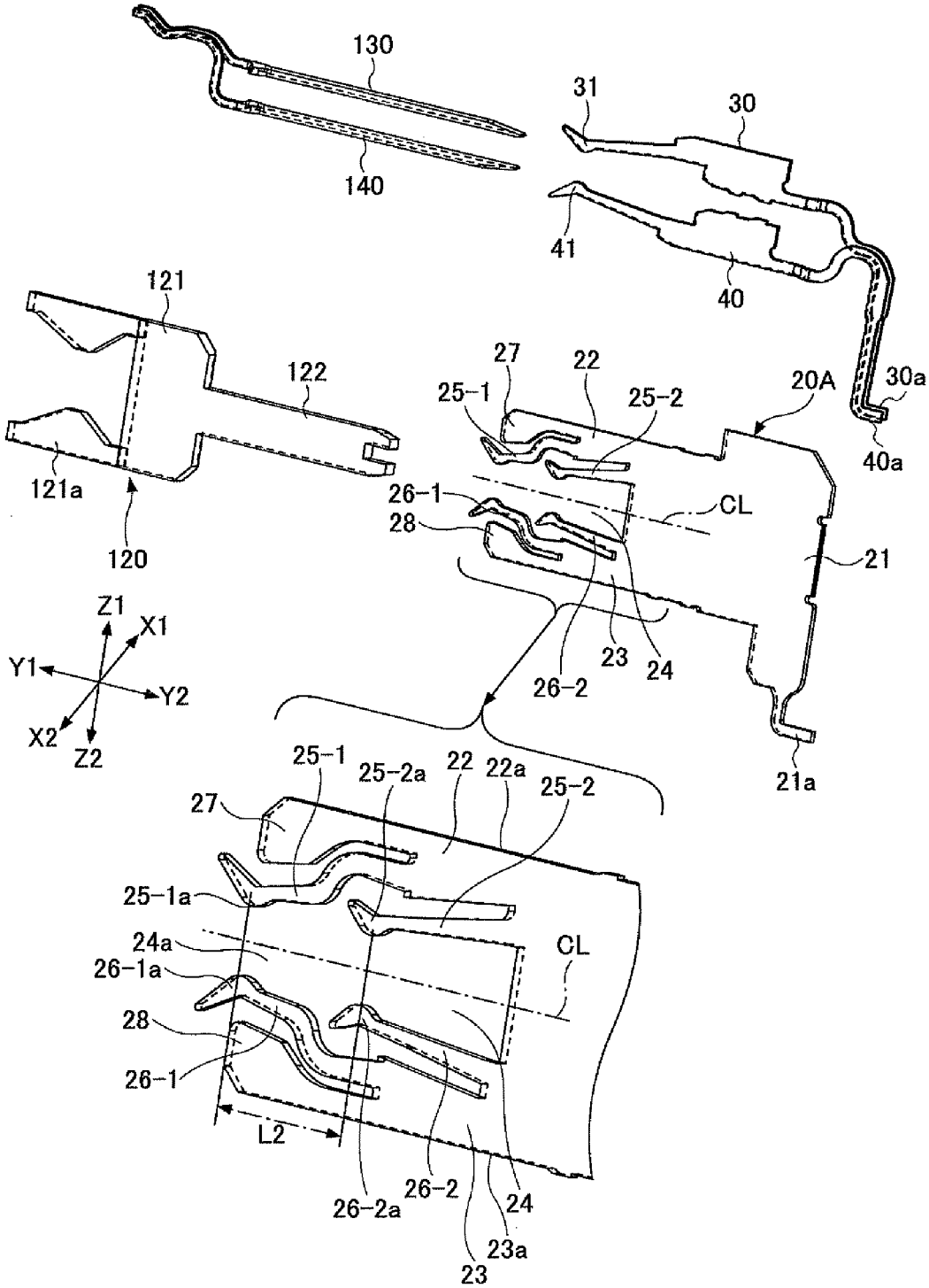
FIG. 8 depicts a perspective view of contacts of the jack connector and contacts of the plug connector in such a manner to illustrate a correspondence relationship therebetween.

The plug connector 100 depicted in FIG. 2A is identical to the plug connector 100 described above with reference to FIGS. 1A and 1B. As depicted in FIG. 8, sheet-shaped plug ground contacts (simply referred to as ground contacts, hereinafter) 120, and pairs of first and second plug signal contacts (simply referred to as first and second signal contacts, hereinafter) 130, 140, are built into slits of an electrically insulating plug block member 160 (see FIG. 2A). Further, an intermediate substrate 150 is connected to the ground contacts 120 and the first and second signal contacts 130, 140. These components are covered by a shield cover 170 (see FIG. 2A).

The first and second signal contacts 130, 140 in each pair, as depicted in FIG. 8, are arranged in vertical directions, or the column directions (Z1-Z2 directions).

The ground contacts 120 and the pairs of first and second contacts 130, 140 are arranged alternately in horizontal directions or the row directions (X1-X2 directions).

As depicted in FIG. 8, each ground contact 120 includes a sheet-shaped root part 121, and a strip-shaped center arm part 122 which extends in the Y2 direction from the root part 121, and has a size such as to correspond to a gulf part 24 which will be described later. The root part 121 has, on the Y1-direction side, terminal parts 121*a* which hold the intermediate substrate 150 between the terminal parts 121*a*.

[Configuration of Jack Connector 10A]

Figure 4:
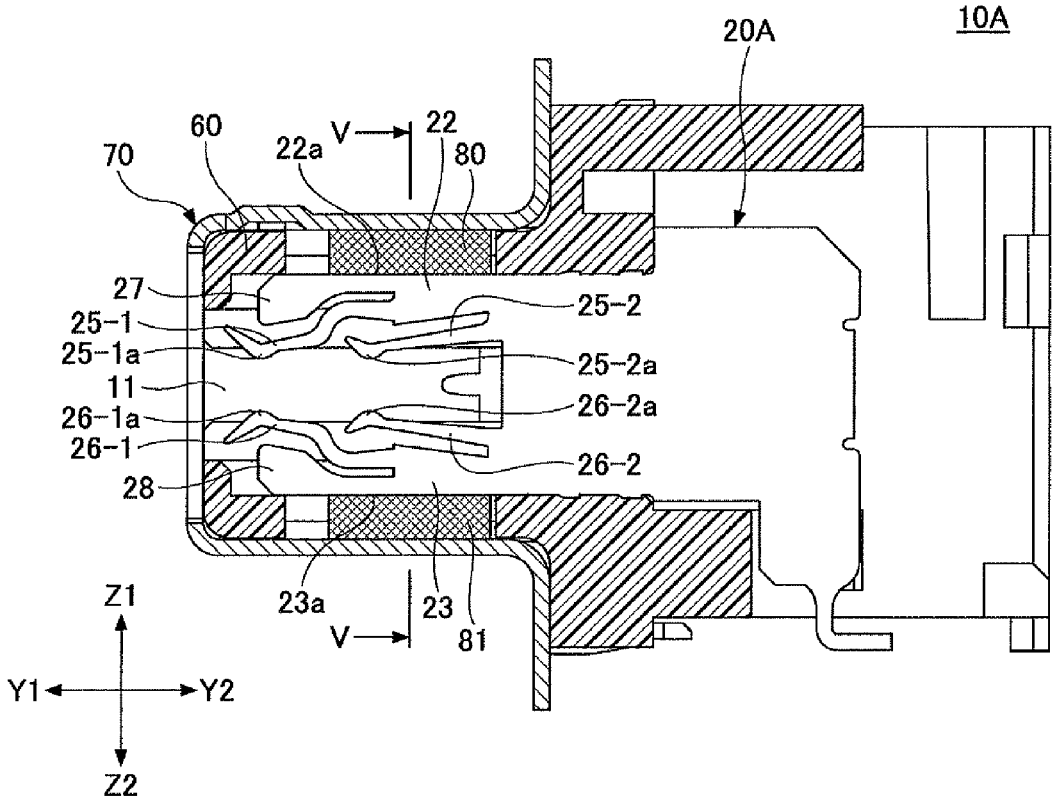
FIG. 4 depicts a longitudinal sectional view of the jack connector depicted in FIG. 2B.
Figure 5:
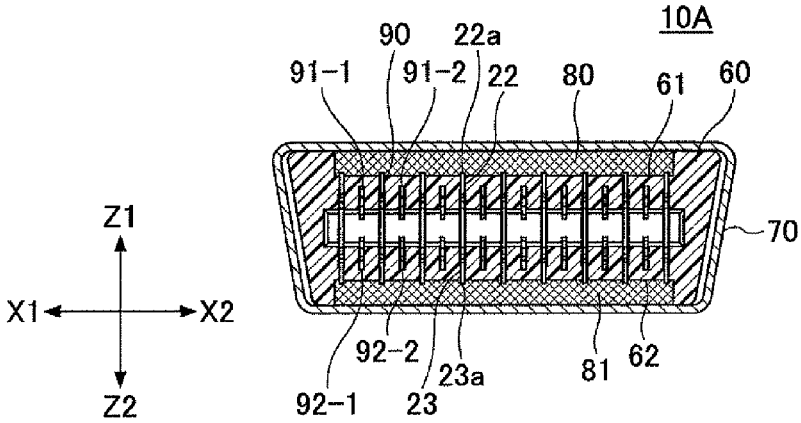
FIG. 5 depicts a cross-sectional view of the jack connector taken along a line V-V of FIG. 4.

As depicted in FIGS. 4 and 5, the jack connector 10A is configured such that, sheet-shaped jack ground contacts (simply referred to as ground contacts, hereinafter) 20A, and pairs of first and second jack signal contacts (simply referred to as first and second signal contacts, hereinafter) 30, 40, as depicted in FIG. 8, are built into slits of an electrically insulating jack block member 60, and further, gaskets 80, 81 and a shield case 70 are included in the jack connector 10A.

The first and second signal contacts 30, 40 in each pair, as depicted in FIG. 8, are arranged vertically or in the column directions (Z1-Z2 directions). The first and second signal contacts 30, 40 have contact parts 31, 41, respectively, at extending ends.

The ground contacts 20A and the pairs of the first and second signal contacts 30, 40 are arranged alternately horizontally or in the row directions (X1-X2 directions).

As depicted in FIG. 8, each ground contact 20A includes a sheet-shaped root part 21, an upper arm part 22 and a lower arm part 23 each extending from the root part 21 in a direction toward the plug connector 100 to be connected or in the Y1 direction apart from one another in the Z1-Z2 directions, and spring parts 25-1, 25-2, 26-1 and 26-2 formed on the side of the gulf part 24 and having elasticity in the Z1-Z2 directions. Between the upper arm part 22 and the lower arm part 23, the gulf part 24 is formed to extend in the Y2 direction. The root part 21 has a terminal part 21*a* on the side of the Y2 direction to be used to connect to a printed circuit board 200.

The upper arm part 22 and the lower arm part 23, the pair of the first spring parts 25-1, 26-1 and the pair of the second spring parts 25-2, 26-2 are arranged symmetrically with respect to a center line CL depicted in FIG. 8 extending along the Y1-Y2 directions in the gulf part 24.

The first spring parts 25-1, 26-1 obliquely extend from approximately the center in the Y1-Y2 directions of the upper and lower arm parts 22, 23 toward an entrance 24*a* of the gulf part 24, and have contact parts 25-1*a*, 26-1*a* at the extending ends. The contact part 25-1*a* is provided on a further extending end side from a wall part 27 (described below) which is an extending end of the upper arm part 22. The contact part 26-1*a* is provided on a further extending end side from a wall part 28 (described below) which is an extending end of the lower arm part 23.

The second spring parts 25-2, 26-2 obliquely extend from root portions of the upper and lower arm parts 22, 23 toward the entrance 24*a* of the gulf part 24, are shifted from the first spring parts in the Y2 direction, and have contact parts 25-2*a*, 26-2*a* at the extending ends. The contact parts 25-2*a*, 26-2*a* are shifted from the entrance 24*a* of the gulf part 24 in the Y2 direction by a length L2, and are provided at approximately the center in the depth directions (Y1-Y2 directions) of the gulf part 24.

The first and second spring parts 25-1, 26-1, 25-2, and 26-2 have cantilever shapes, respectively, and the respective extending ends 25-1*a*, 26-1*a*, 25-2*a* and 26-2*a* are elastically movable in the Z1-Z2 directions.

The upper arm part 22 has the wall part 27 at a position in the Z1 direction from the spring part 25-1. The lower arm part 23 has the wall part 28 at a position in the Z2 direction from the spring part 26-1.

Figure 9A:
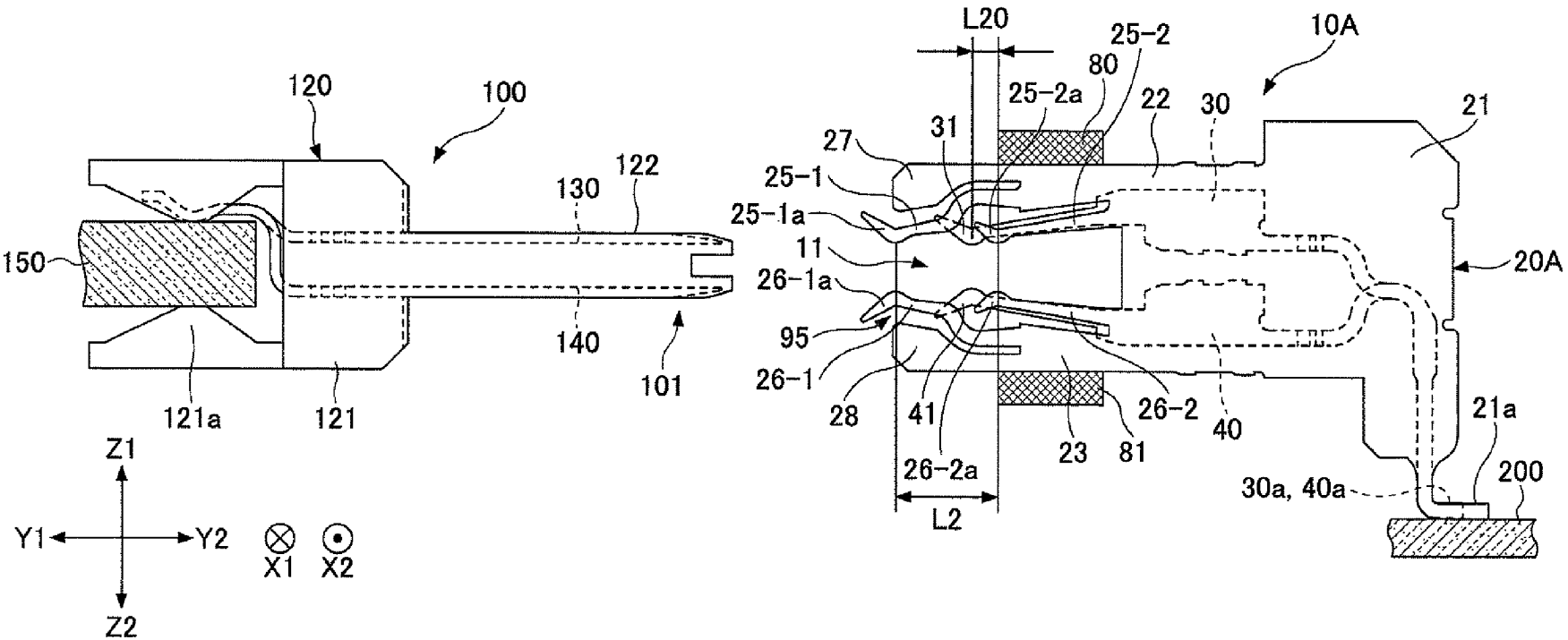
FIGS. 9A and 9B depict contacts of the plug connector and the jack connector in a state in which the plug connector and the jack connector are connected together.

As depicted in FIG. 9A, along the Y2 direction, the contact parts 25-1*a*, 26-1*a*, the contact parts 31, 41 (of the first and second signal contacts 30, 40), and the contact parts 25-2*a*, 26-2*a* are arranged in the stated order. The contact parts 25-2*a*, 26-2*a* are shifted from the contact parts 31, 41 in the Y2 direction by a distance L20.

Figure 6:
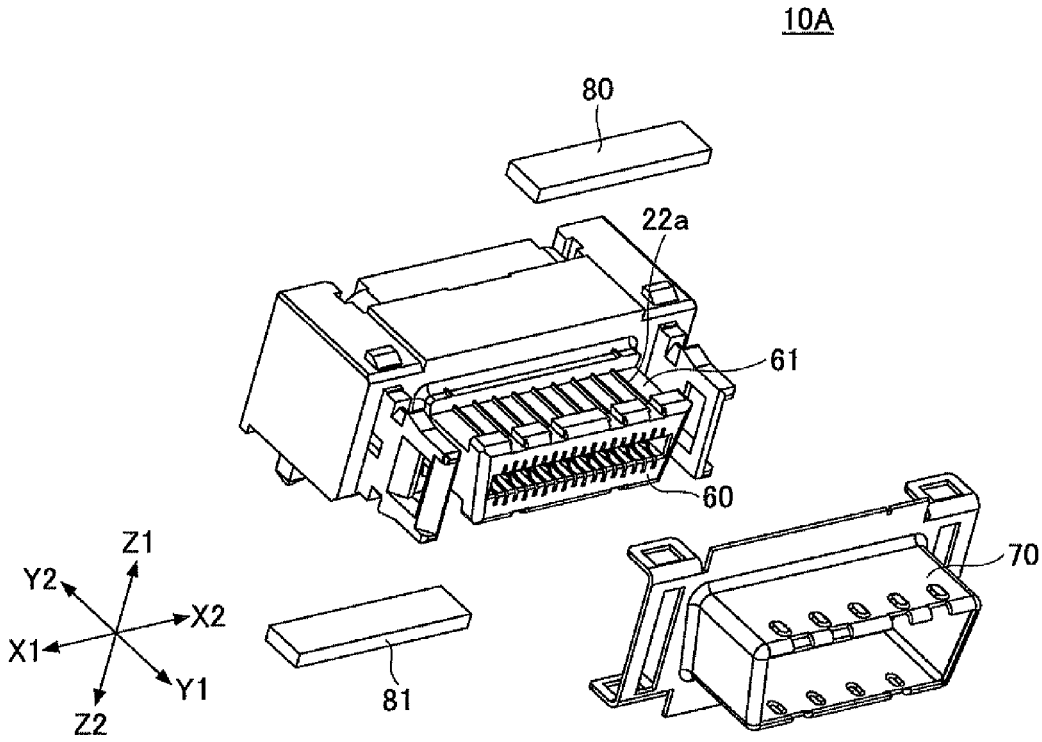
FIGS. 6 and 7 illustrate mounting of gaskets.

As depicted in FIG. 6, top edges 22*a* of the upper arm parts 22 are exposed from a top surface 61 of the jack block member 60. As depicted in FIG. 5, similarly, bottom edges 23*a* of the lower arm parts 23 are exposed from a bottom surface 62 of the jack block member 60.

As depicted in FIG. 6, the gaskets 80, 81 are rectangular-sheet-shaped, and have electrical conductivity and elasticity. The shield case 70 is made of a metal, and has a shape corresponding to a shape of a front end of the jack block member 60. The gaskets 80, 81 act as electrical common connecting members. The gaskets 81, 81 may be made of, for example, sheet metal, sponge, rubber or such.

As depicted in FIGS. 2A, 2B and 4, the shield case 70 is built to the jack block member 60. The gaskets 80, 81 are inserted between the jack block member 60 and the shield case 70, and are thus pressed thereby. Each of the gaskets 80, 81 extends over all the ground contacts 20A, the gasket 80 in the thus-pressed state elastically comes into contact with the top ends 22*a* of the upper arm parts 22 of all the ground contacts 20A, and the gasket 81 in the thus-pressed state elastically comes into contact with the bottom ends 23*a* of the lower arm parts 23 of all the ground contacts 20A. Thereby, all the ground contacts 20A are electrically connected together through the upper arm parts 22 by means of the gasket 80, and are electrically connected together through the lower arm parts 23 by means of the gasket 81.

In a state in which the jack connector 10A is mounted to the printed circuit board 200, the shield case 70 is electrically connected to a ground pattern of the printed circuit board 200, and the gaskets 80, 81 are at a ground electric potential.

Figure 7:
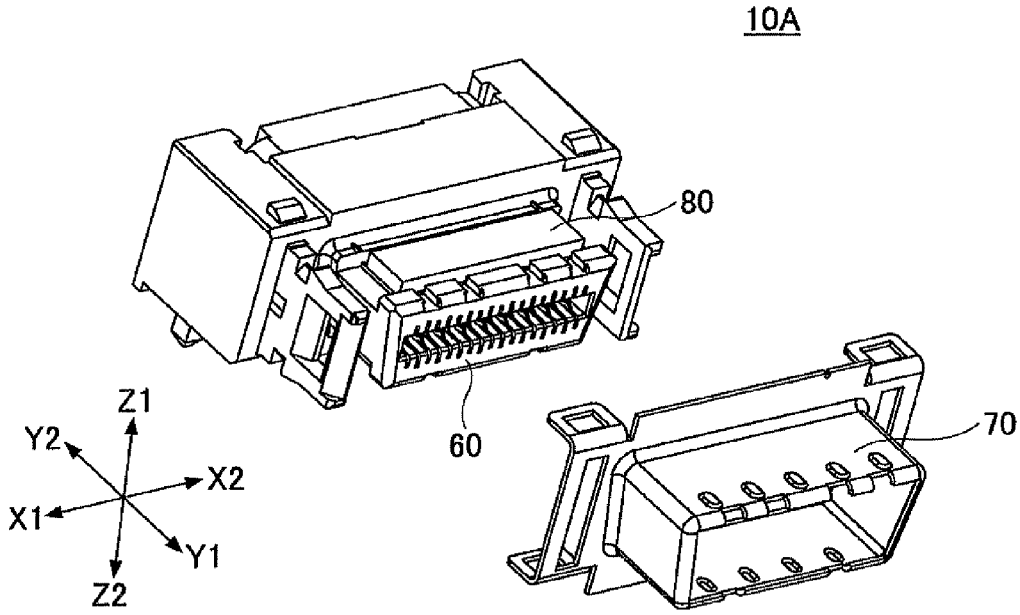

As depicted in FIGS. 6 and 7, the gaskets 80, 81 are placed on the top surface 61 and the bottom surface 62 of the jack block member 60, respectively, the shield case 70 is built to the jack block member 60 in the Y2 direction, and thus, the gaskets 80, 81 are built into the jack connector 10A. Thus, the gaskets 80, 81 are built into the jack connector 10A in a process in which the shield case 70 is built to the jack block member 60. Thus, the gaskets 80, 81 can be easily built into the jack connector 10A.

FIG. 8 depicts a state in which one pair of the first and second signal contacts 130, 140 and one of the ground contacts 120 of the plug connector 100 and one pair of the first and second signal contacts 30, 40 and one of the ground contacts 20A of the jack connector 10A face each other, respectively, in a state in which the jack connector 10A and the plug connector 100 face one another.

[Connecting Plug Connector 100 to Jack Connector 10A]

Next, an operation of connecting the plug connector 100 to the jack connector 10A, and a state in which the connection is completed, will be described.

As depicted in FIGS. 3 and 9A, in the jack connector 10A, terminal parts 30*a*, 40*a* of the first and second signal contacts 30, 40 are soldered to corresponding signal pads (not depicted) provided on a top surface of the printed circuit board 200, and the terminal parts 21*a* of the ground contacts 20A are soldered to corresponding ground pads (not depicted) provided on the top surface of the printed circuit board 200. Thus, the jack connector 10A is mounted to the printed circuit board 200. The shield case 70 is electrically connected to the ground pattern of the printed circuit board 200.

The plug connector 100 is mounted to an end of a coaxial cable (not shown).

Figure 9B:
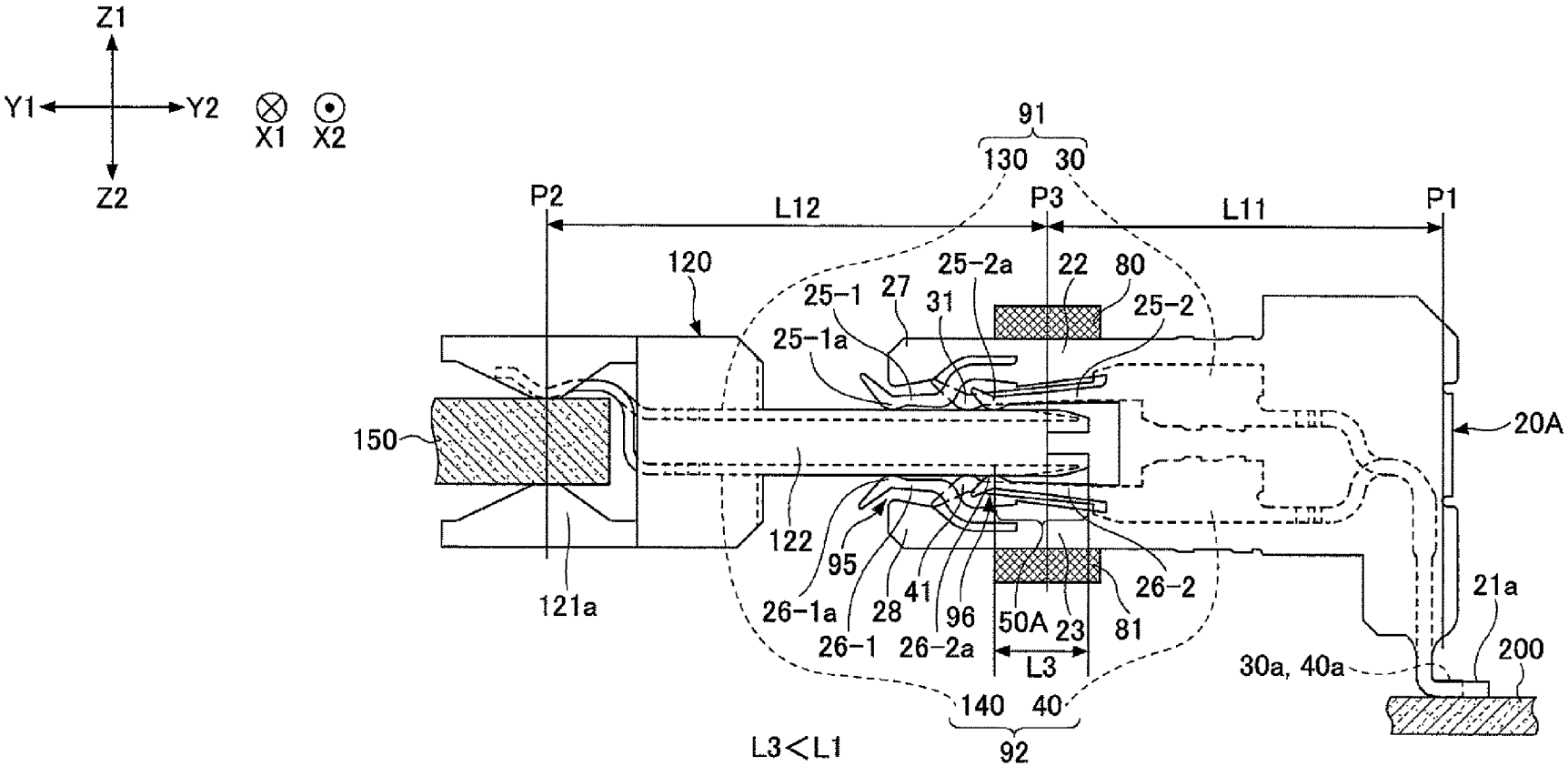

As a result of an extending part 101 (see FIG. 2 and FIG. 9A) including the first and second signal contacts 130, 140 and the ground contacts 120 of the plug connector 100, being inserted into a recess part 11 (see FIG. 2 and FIG. 9A) including the gulf parts 24 of the ground contacts 20A and spaces formed between the first and second signal contacts 30, 40 of the jack connector 10A in the Y2 direction, the plug connector 100 is connected to the jack connector 10A, as depicted in FIGS. 3 and 9B.

In the process of thus connecting the plug connector 100 to the jack connector 10A, the center arm part 122 of each of the ground contacts 120 of the plug connector 100 is inserted into the gulf part 24 of each of the ground contacts 20A of the jack connector 10A. In this process, the center arm part 122 of each ground contact 120 of the plug connector 100 first comes into contact with the contact parts 25-1*a*, 26-1*a* of each ground contact 20A of the jack connector 10A, then each pair of the first and second signal contacts 130, 140 of the plug connector 100 come into contact with the contact parts 31, 41 of each pair of the first and second signal contacts 30, 40 of the jack connector 10A, respectively, and finally, the center arm part 122 of each ground contact 120 of the plug connector 100 comes into contact with the contact parts 25-2*a*, 26-2*a* of each ground contact 20A of the jack connector 10A.

In this process, respective portions of each ground contact 20A of the jack connector 10A and each ground contact 120 of the plug connector 100 at which the contact parts 25-1*a*, 26-1*a* of each ground contact 20A of the jack connector 10A come into contact with the center arm part 122 of each ground contact 120 of the plug connector 100 are included in a first contact structure 95 of the balanced transmission connector device 1A. Similarly, respective portions of each ground contact 20A of the jack connector 10A and each ground contact 120 of the plug connector 100 at which the contact parts 25-2*a*, 26-2*a* of each ground contact 20A of the jack connector 10A come into contact with the center arm part 122 of each ground contact 120 of the plug connector 100 are included in a second contact structure 96 of the balanced transmission connector device 1A.

The center arm part 122 of each ground contact 120 of the plug connector 100 is inserted into the gulf part 24 of each ground contact 20A of the jack connector 10A, and occupies the gulf part 24. Thus, the center arm part 122 of each ground contact 120 of the plug connector 100, and the upper and lower arm parts 22, 23 of each ground contact 20A of the jack connector 10A form a plane sheet as a result of being thus combined together, as depicted in FIG. 9A. Each ground contact 20A of the jack connector 10A and each ground contact 120 of the plug connector 100 in the above-mentioned state in which the center arm part 122 of each ground contact 120 of the plug connector 100 and the upper and lower arm parts 22, 23 of each ground contact 20A of the jack connector 10A are combined together as mentioned above, form a ground contact assembly 90. The ground contact assembly 90 is plane-sheet-shaped.

As will be described later, a stub 50A formed at an extending end portion of the center arm part 122 of each ground contact 120 of the plug connector 100 has a length L3, which is as small as approximately half the length L1 of the above-mentioned stub 50 of the balanced transmission connector device 1 in the related art.

The first signal contact 30 of each pair of the first and second signal contacts 30, 40 of the jack connector 10A and the first signal contact 130 of each pair of the first and second signal contacts 130, 140 of the plug connector 100, which are arranged in the Y1-Y2 directions and are in contact together, form a positive signal transmission path 91. Similarly, the second signal contact 40 of each pair of the first and second signal contacts 30, 40 of the jack connector 10A and the second signal contact 140 of each pair of the first and second signal contacts 130, 140 of the plug connector 100, which are arranged in the Y1-Y2 directions and are in contact together, form a negative signal transmission path 92. A positive signal is transmitted through the positive signal transmission path 91 and a negative signal is transmitted through the negative signal path 92.

As depicted in FIG. 5, in the X1-X2 directions, adjacent ones of the positive signal transmission paths 91 (referred to as 91-1, 91-2, for example) and adjacent ones of the negative signal transmission paths 92 (referred to as 92-1, 92-2, for example) are shielded by the above-mentioned ground contact assembly 90, respectively. Since a positive signal and a negative signal have equal amplitudes and have opposite directions, a vertical ground plane is formed, for example, between the positive signal transmission path 91-1 and the negative signal transmission path 92-1, when a data signal is transmitted by using corresponding positive and negative signals. Further, the Z1-direction end of the positive signal transmission path 91-1 and the Z2-direction end of the negative signal transmission path 92-1 are covered by the shield case 70 which acts as a frame ground.

Therefore, in a portion of the balanced transmission connector device 1A at which the plug connector 100 is connected to the jack connector 10A, each of the positive signal transmission paths 91-1, 91-2, for example, and each of the negative signal transmission paths 92-1, 92-2, for example, have pseudo coaxial configurations, respectively, and each positive signal and each negative signal which form a data signal are transmitted through respective signal transmission paths each being shielded on the periphery thereof and having a coaxial configuration.

Because a data signal to be transmitted by the balanced transmission connector device 1A is a radio frequency signal, a radio frequency ground current flows through a combination of each ground contact 20A of the jack connector 10A and each ground contact 120 of the plug connector 100, i.e., the above-mentioned ground contact assembly 90.

[Improving Crosstalk Characteristic in Balanced Transmission Connector Device 1A]

Next, a crosstalk characteristic of the balanced transmission connector device 1A will be described.

<A> Improving A Crosstalk Characteristic By Using Second Spring Parts 25-2, 26-2

With reference to FIG. 9B, the first spring parts 25-1, 26-1 of each ground contact 20A of the jack connector 10A provide returning paths of the radio frequency ground current. In addition, the second spring parts 25-2, 26-2 of each ground contact 20A of the jack connector 10A also provide returning paths of the radio frequency ground current. Furthermore, the above-mentioned first contact structure 95 and the second contact structure 96 also provide returning paths of the radio frequency ground current.

Each ground contact 20A of the jack connector 10A has the first contact structure at the extending end of the ground contact 20A, and the returning paths of the radio frequency ground current are provided thereby. As a result, the ground contact 20A has no stub.

A position at which each ground contact 120 of the plug connector 100 comes into contact with each ground contact 20A of the jack connector 10A nearest to the extending end of the center arm part 122 of the ground contact 120 of the plug connector is a position of the second contact structure 96. This position is apart from the extending end of the center arm part 122 in the direction of the root part 121 by a distance L3. Therefore, a portion of the center arm part 122 extending on the side of the second contact structure 96 acts as the stub 50A.

It is noted that, the second contact structure 96 is located at a position apart from the entrance 24*a* of the gulf part 24 in the Y2 direction by a distance L2 as depicted in FIG. 9A. Thus, the position of the second contact structure 96 is near to the extending end of the center arm part 122. Therefore, the stub 50A has the length L3, which is approximately half the length L1 of the stub 50 of the balanced transmission connector device 1 in the related art depicted in FIGS. 1A and 1B. Thus, the stub 50A in the embodiment is shortened with respect to the stub 50 in the related art.

Figure 10:
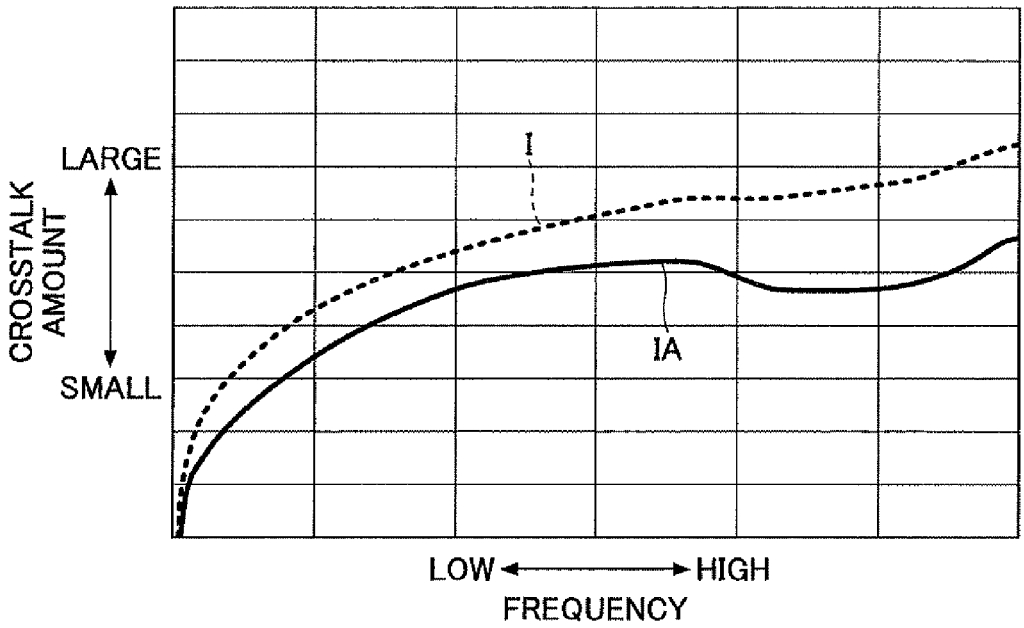
FIG. 10 illustrates improvement of a crosstalk characteristic as a result of second spring parts being formed in the balanced transmission connector device.

Therefore, an influence of reflection of the radio frequency ground current at the extending end of the stub 50A is reduced, noise occurring from the reflection through the stub 50A is reduced, an influence of the noise on a data signal transmitted by each positive signal transmission path 91 and each negative signal transmission path 92 is reduced, and as a result, a crosstalk characteristic is improved as depicted in FIG. 10, a graph line IA, in comparison to the related art (graph line I).

Furthermore, since the stub 50A in the embodiment is shortened as mentioned above in comparison to the stub 50 in the related art, the stub becomes shorter with respect to the signal wavelength. Thus, an influence of the stub on impedance of each positive signal transmission path 91 and impedance of each negative signal transmission path 92 is reduced. Therefore, the impedance of each positive signal transmission path 91 and the impedance of each negative signal transmission path 92 are improved accordingly.

<B> Improving Crosstalk Characteristic By Means Of Gaskets 80, 81

With reference to FIG. 9B, all the ground contacts 20A of the jack connector 10A are connected to a so-called "solid" plane ground layer provided in the inside of the printed circuit board 200 in common at a position P1. All the ground contacts 120 of the plug connector 100 are a so-called "solid" plane ground layer provided in the inside of the intermediate substrate 150 in common at a position P2.

Further, all the ground contacts 20A of the jack connector 10A are connected to the gaskets 80, 81 in common at a position P3 located between the positions P1 and P2, and further, are connected to the so-called "solid" plane ground layer in the inside of the printed circuit board 200, through the gaskets 80, 81 and the shield case 70.

All the ground contacts 120 of the plug connector 100 are connected to the gaskets 80, 81 in common at the same point P3 through the corresponding respective ground contacts 20A of the jack connector 10A, and further, are connected to the so-called "solid" plane ground layer in the inside of the printed circuit board 200, through the gaskets 80, 81 and the shield case 70.

Figure 1A:
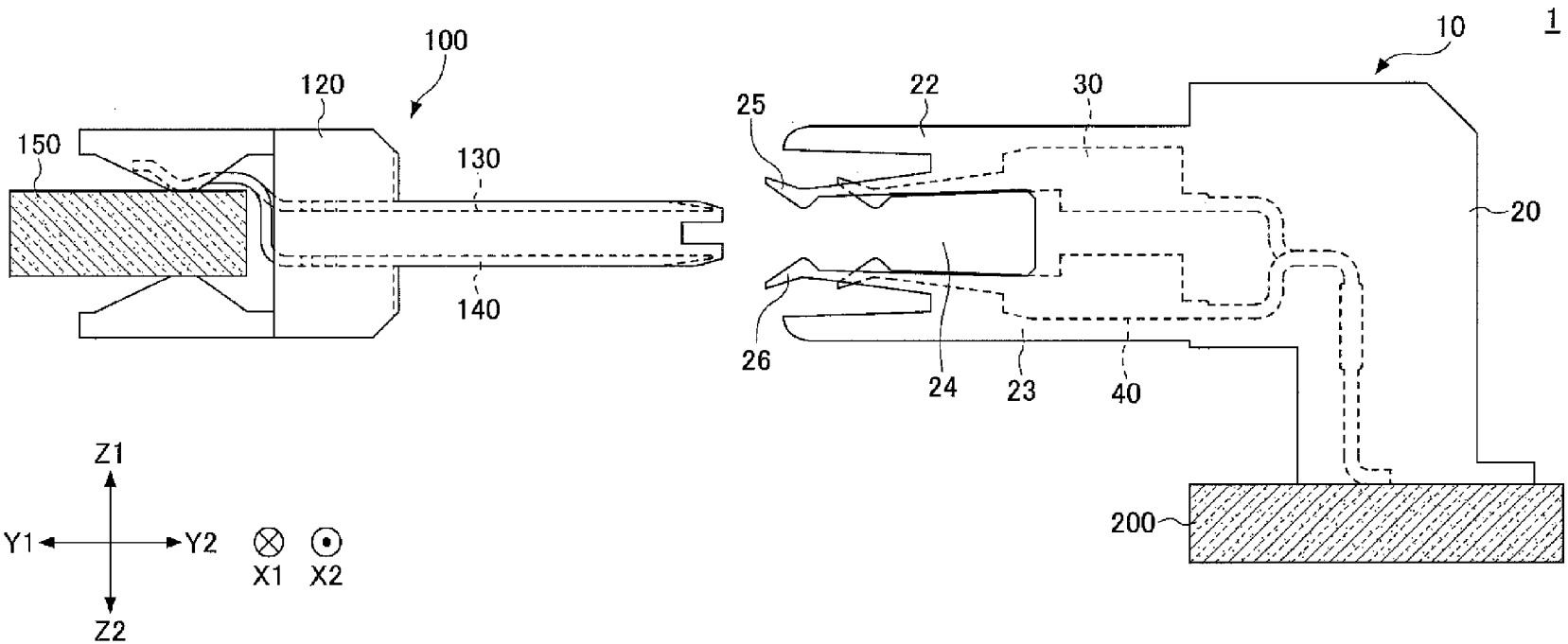
FIG.1A RELATED ART
FIGS. 1A and 1B depict contacts of a jack connector and contacts of a plug connector in a balanced transmission connector device in the related art.
Figure 1B:
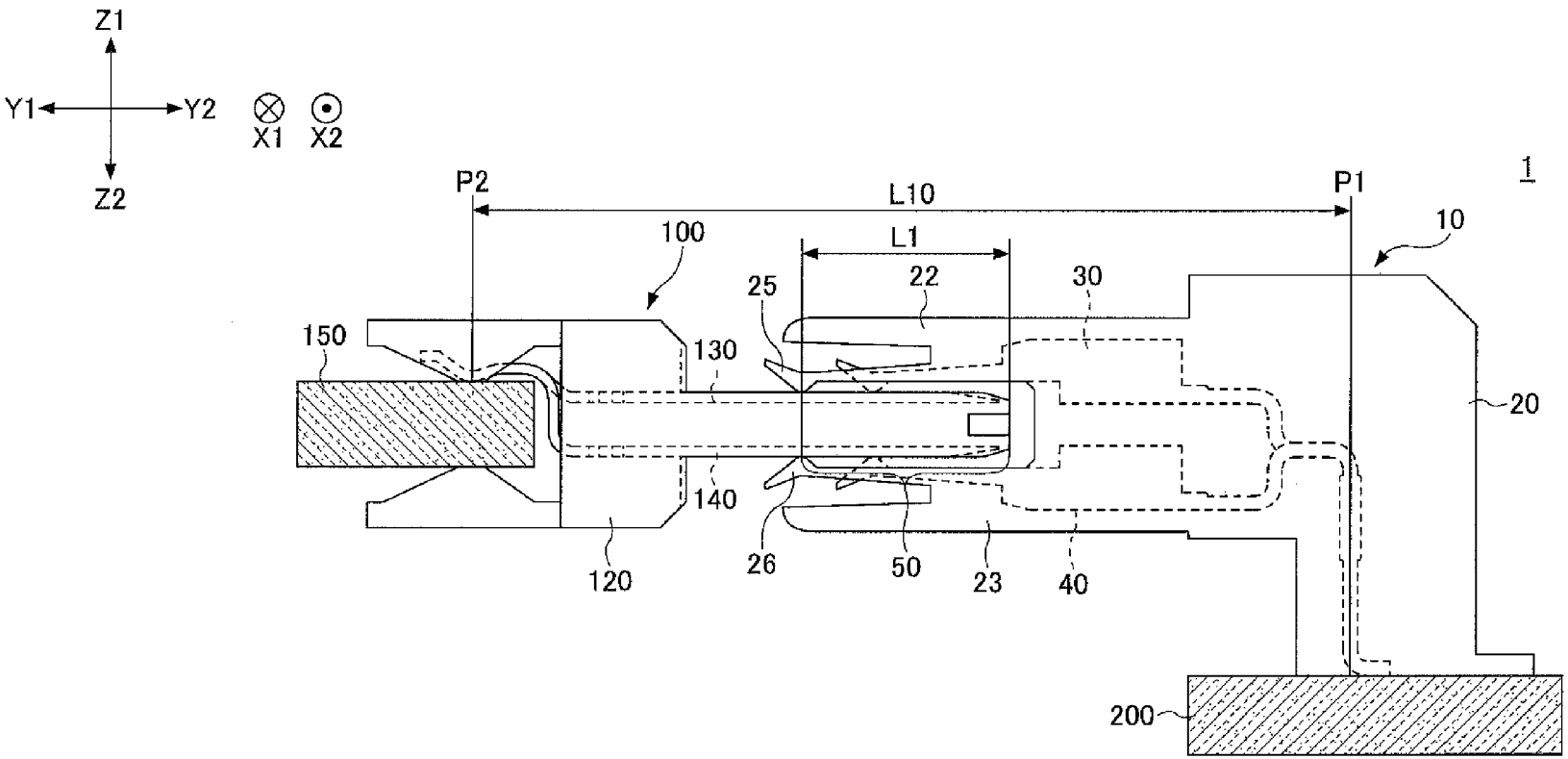
FIG.1B RELATED ART

Therefore, a distance between the positions at which all the ground contacts 20A of the jack connector 10A are in common connected is a distance L11 between the positions P1 and P3, as depicted in FIG. 9B, which is approximately half a distance L10 between positions P1 and P2 in the related art depicted in FIG. 1B. Similarly, a distance between the positions at which all the ground contacts 120 of the plug connector 100 are connected in common is a distance L12 between the positions P2 and P3, as depicted in FIG. 9B, which is approximately half a distance L10 between positions P1 and P2 in the related art depicted in FIG. 1B.

Figure 11:
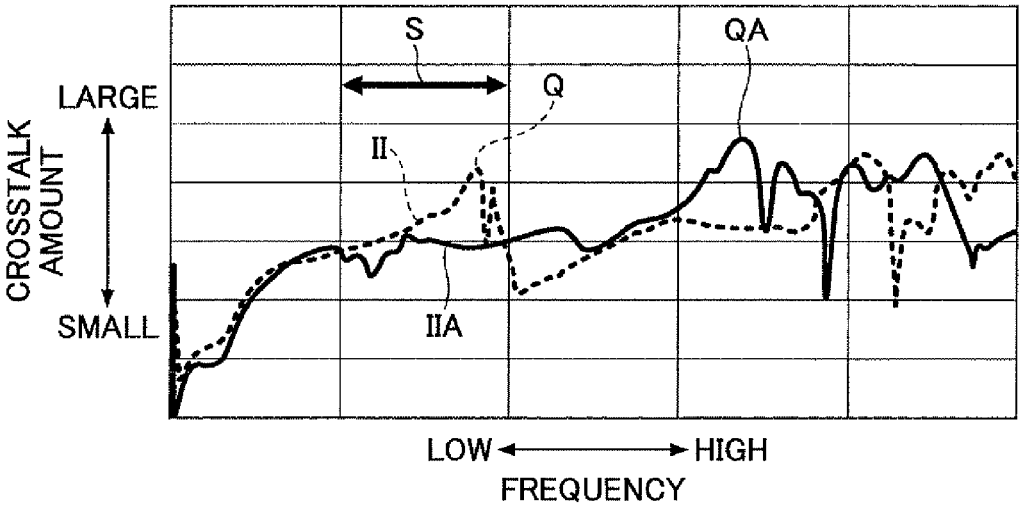
FIG. 11 illustrates improvement of a crosstalk characteristic as a result of gaskets being provided in the balanced transmission connector device.

Thereby, a resonance frequency of the radio frequency ground current is shifted to the high frequency side. This is because a resonance wavelength of the radio frequency ground current is shortened as a result of the distance between the positions at which all the ground contacts 20A of the jack connector 10A are connected in common being shortened, and the distance between the positions at which all the ground contacts 120 of the plug connector 100 are connected in common being shortened, as mentioned above. As a result, as depicted in FIG. 11, a graph line IIA, a peak QA of a crosstalk amount is shifted to the high frequency side, and thus, is removed from a frequency band S of a data signal to be transmitted by the balanced transmission connector device 1A. Thus, a crosstalk characteristic in the frequency band S of the data signal improves.

Another configuration of a balanced transmission connector device in which either one of the gaskets 80, 81 is omitted may also be applied. In the configuration, only either the upper arm parts 22 or the lower arm parts 23 are electrically connected in common. Also in the configuration, a crosstalk characteristic improves in comparison to the related art as mentioned above.

Further another configuration of a balanced transmission connector device in which portions near to the extending ends of the center arm parts 122 of the ground contacts 120 of the plug connector 100 are electrically connected in common. Also in the configuration, a crosstalk characteristic improves as mentioned above.

<C> Improving Crosstalk Characteristic By Using Wall Parts 27, 28

The wall parts 27, 28 are provided in the balanced transmission connector device 1A as mentioned above. As a result, the ground contact t assemblies 90 extend in the Y1 direction as long as possible.

Thereby, a shielding effect of the ground contact assemblies is improved.

Embodiment 2

Figure 12:
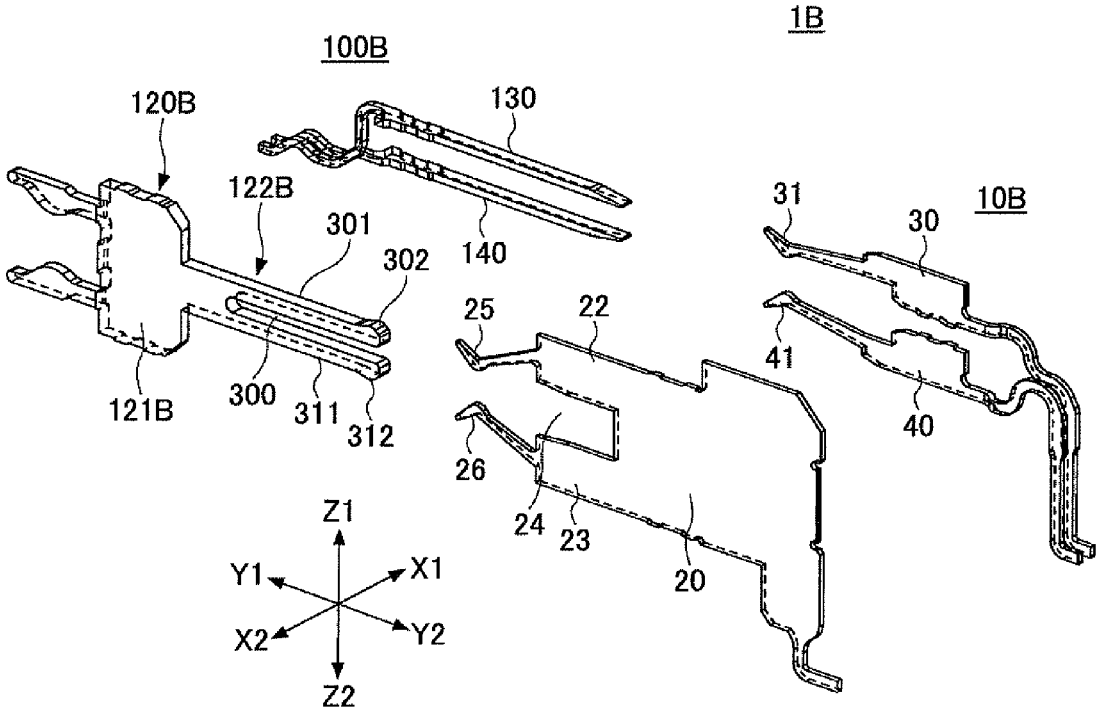
FIG. 12 depicts a perspective view of contacts of a jack connector and contacts of a plug connector of a balanced transmission connector device in an embodiment 2 of the present invention in such a manner to illustrate a correspondence relationship therebetween.
Figure 13A:
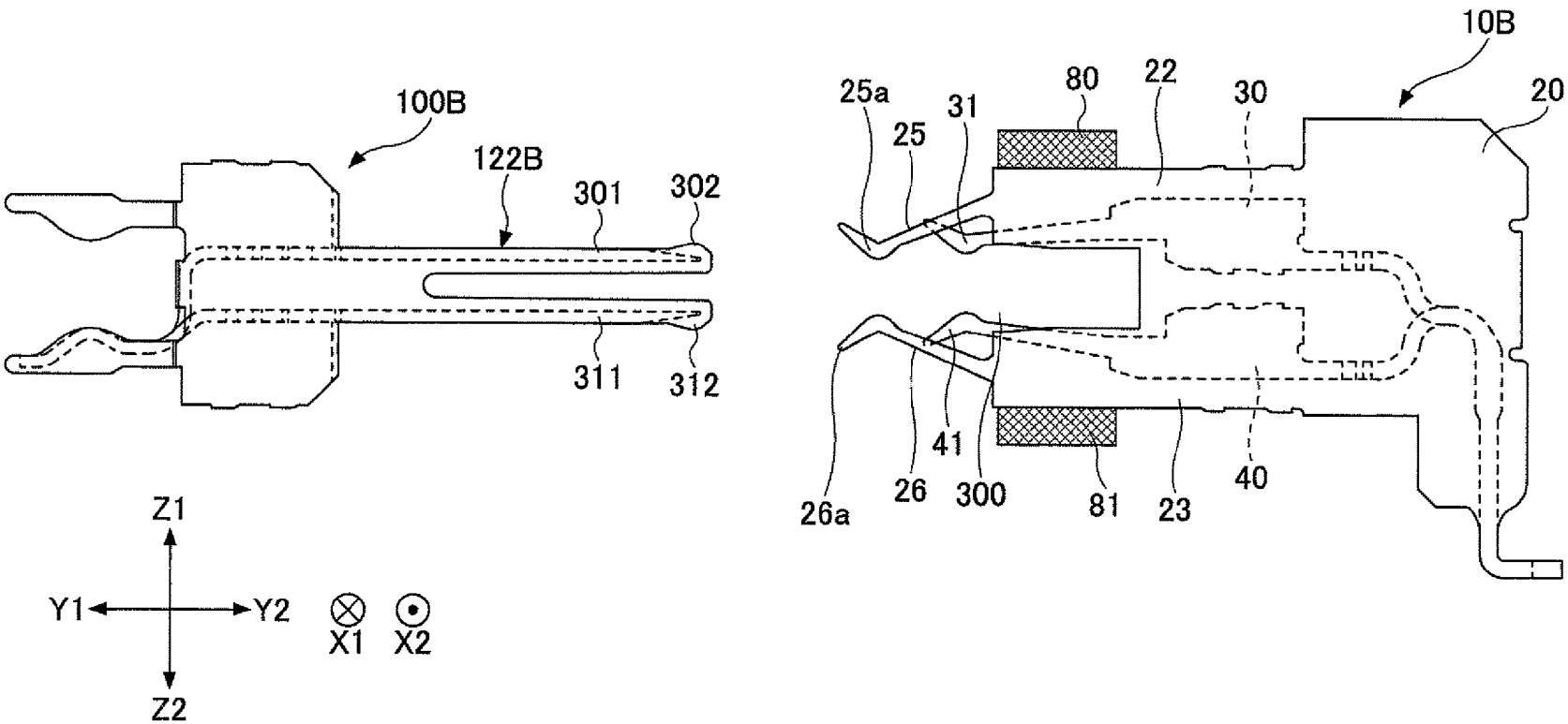
FIGS. 13A and 13B depict connection of contacts of the plug connector to contacts of the jack connector.
Figure 13B:
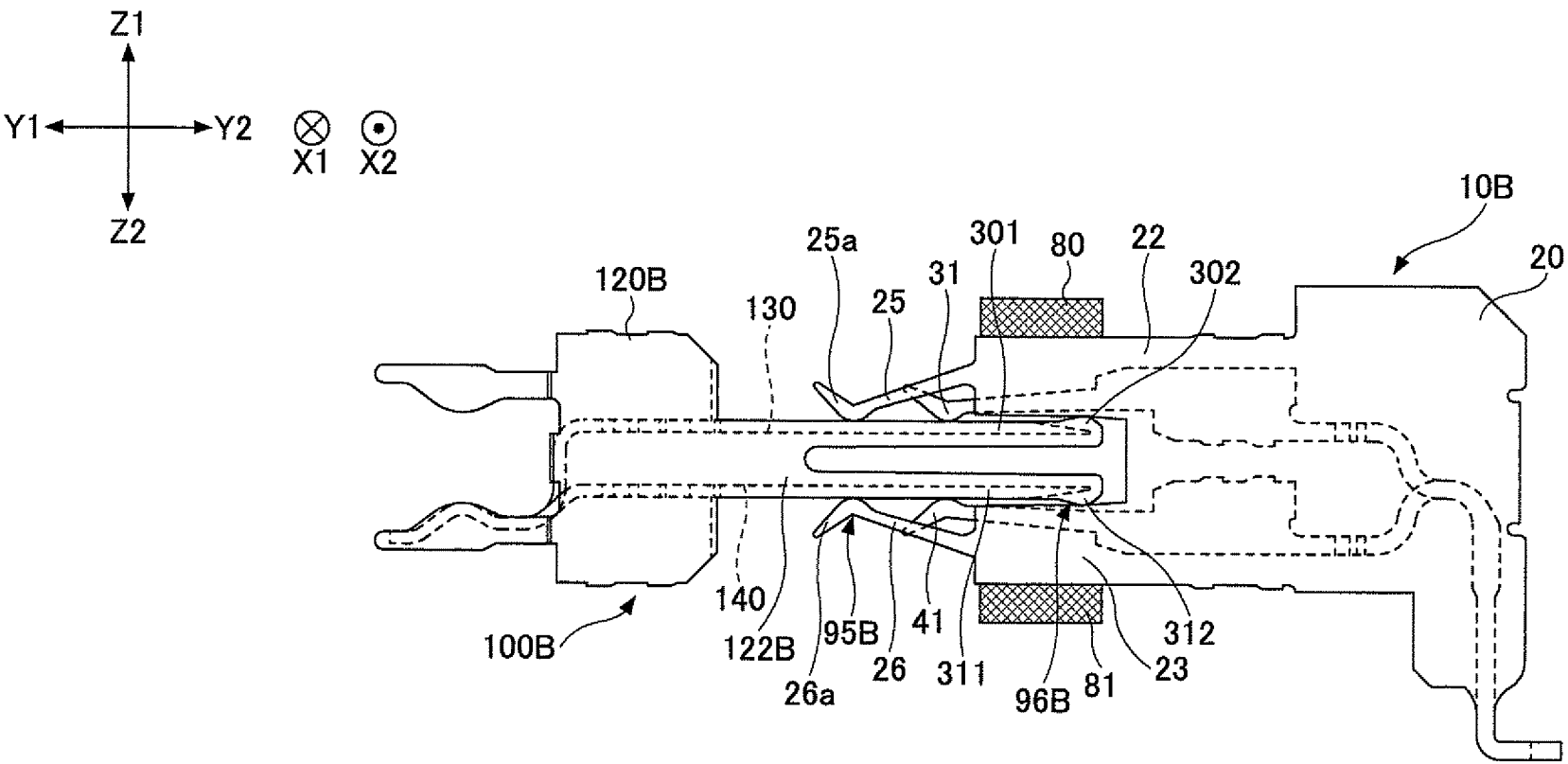

FIGS. 12, 13A and 13B depict a balanced transmission connector device 1B in an embodiment 2 of the present invention, in such a manner that respective contacts face each other. The balanced transmission connector device 1B includes a jack connector 10B and a plug connector 100B.

The jack connector 10B and the plug connector 100B are identical to the jack connector 10 and the plug connector 100 depicted in FIGS. 1A, 1B, respectively, except for the following points. The same reference numerals are given to the same/corresponding parts/components, and duplicate description will be omitted appropriately.

The jack connector 10B is configured such that the above-mentioned gaskets 80, 81 are provided to the jack connector 10 depicted in FIGS. 1A, 1B, and includes first and second signal contacts 30, 40 and ground contacts 20.

The plug connector 100B includes first and second signal contacts 130, 140 and ground contacts 120B, in which the ground contacts 120B are modified from the ground contacts 120 of the plug connector 100 depicted in FIGS. 1A, 1B.

Each ground contact 120E of the plug connector 100B has a strip-shaped center arm part 122B, which has a slit 300 extending from the extending end of the center arm part 122B toward a root part 121B. By this slit 300, a pair of first and second center arm spring parts 301, 311 are formed, and the first and second center arm spring parts 301, 311 are included in the center arm part 122B.

The first center arm spring part 301 has a contact part 302 projecting upward from the extending end in the Y2 direction of the first center arm spring part 301, as depicted in FIG. 12. The second center arm spring part 311 has a contact part 312 projecting downward from the extending end in the Y2 direction of the second center arm spring part 311, as depicted in FIG. 12.

When the plug connector 100B is connected to the jack connector 10B, the center arm part 122B of each ground contact 120B of the plug connector 100B comes into contact with the contact parts 25*a*, 26*a* of the extending ends of the spring parts 25, 26 of each ground contact 20 of the jack connector 10B. Further, each pair of the first and second signal contacts 130, 140 of the plug connector 100B come into contact with the contact parts 31, 41 of each pair of the first and second signal contacts of the jack connector 10B, respectively. In a process where the center arm part 122B of each ground contact 120E of the plug connector 100B is inserted into the gulf part 24 of each ground contact 120B of the jack connector 10B, the first and second center arm spring parts 301, 311 of the center arm part 122B are elastically deformed in such directions that the first and second center arm spring parts 301, 311 approach one another. Thus, the contact parts 302, 312 of the first and second center arm spring parts 301, 311 of each ground contact 120B of the plug connector 100B come into contact with respective inner edges of the upper arm part 22 and the lower arm part 23 of each ground contact 20 of the jack connector 10B.

Thus, the contact parts 25*a*, 26*a* of the spring parts 25, 26 of each ground contact 20 of the jack connector 10B come into contact with each ground contact 120B of the plug connector 100B, and the contact parts 302, 312 of each ground contact 120B of the plug connector 100B come into contact with respective inner edges of the upper arm part 22 and the lower arm part 23 of each ground contact 20 of the jack connector 10B. Portions of the balanced transmission connector device 1B at which the contact parts 25*a*, 26*a* of each ground contact 20B of the jack connector 10B come into contact with the center arm part 122B of each ground contact 120B of the plug connector 100B are included in a first contact structure 95B. Portions of the balanced transmission connector device 1B at which the contact parts 302, 312 of each ground contact 120B of the plug connector 100B come into contact with the inner edges of the upper arm part 22 and the lower arm part 23 of each ground contact 20 of the jack connector 10B are included in a second contact structure 96B.

Therefore, in each ground contact 20 of the jack connector 10B, the spring parts 25, 26 at the extending end of the ground contact 20 provide returning paths of a radio frequency ground current. In each ground contact 120B of the plug connector 100B, the contact parts 302, 312 of the ground contact 120B provide returning paths of a radio frequency ground current.

Therefore, each ground contact 20 of the jack connector 10B and each ground contact 120B of the plug connector 100B have no stub. Thus, the balanced transmission connector device 1B in the embodiment 2 of the present invention has an improved crosstalk characteristic.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment of the present invention has been described in detail, it should be understood that various changes, substitutions, and alterations could be made hereto without departing from the sprit and scope of the invention.

What is claimed is:

1. A connector device, comprising:

a jack connector including a plurality of pairs of jack signal contacts and a plurality of jack ground contacts, wherein each pair of jack signal contacts of the plurality of pairs of jack signal contacts and each jack ground contact of the plurality of jack ground contacts are arranged alternately; and a plug connector including a plurality of pairs of plug signal contacts and a plurality of plug ground contacts, wherein each pair of plug signal contacts of the plurality of pairs of plug signal contacts and each plug ground contact of the plurality of plug ground contacts are arranged alternately, wherein:

respective contacts of each pair of jack signal contacts come into contact with respective contacts of each pair of plug signal contacts, and each jack ground contact comes into contact with each plug ground contact, and the connector device has:

a first contact structure in which each jack ground contact comes into contact with each plug ground contact at a first position; and a second contact structure in which each jack ground contact comes into contact with each plug ground contact at a second position apart from the first position along an extending direction of the plug ground contact.

2. The connector device as claimed in claim 1, wherein:

each jack ground contact includes:

a root part;

an upper arm part and a lower arm part each extending from the root part toward the plug connector, each of which upper arm part and lower arm part has a first spring part and a second spring part each extending in a gulf part; and the gulf part formed between the upper arm part and the lower arm part, and each plug ground contact includes:

a root part; and a center arm part which extends from the root part and is inserted into the gulf part of each jack ground contact, wherein:

in the first contact structure, the first spring part of each of the upper arm part and the lower arm part of the jack ground contact comes into contact with the center arm part of each jack ground contact at the first position along the center arm part, and in the second contact structure, the second spring part of each of the upper arm part and the lower arm part of the jack ground contact comes into contact with the center arm part of each jack ground contact at the second position along the center arm part.

3. The connector device as claimed in claim 2, wherein:

the center arm part includes a pair of center arm spring parts at an extending end of the center arm part.

4. A jack connector, comprising:

a plurality of pairs of jack signal contacts and a plurality of jack ground contacts each being sheet-shaped, wherein each pair of jack signal contacts of the plurality of pairs of jack signal contacts and each jack ground contact of the plurality of jack ground contacts are arranged alternately, wherein:

each jack ground contact includes:

a root part;

an upper arm part and a lower arm part each extending from the root part toward a plug connector acting as a counter part of the jack connector, each of which upper arm part and lower arm part has a first spring part and a second spring part which are apart from one another along an extending direction of each of the upper arm part and the lower arm part and each of which first spring part and second spring part extends in a gulf part; and the gulf part formed between the upper arm part and the lower arm part.

5. A connector device, comprising:

a jack connector including a plurality of pairs of jack signal contacts and a plurality of jack ground contacts, wherein each pair of jack signal contacts of the plurality of pairs of jack signal contacts and each jack ground contact of the plurality of jack ground contacts are arranged alternately; and a plug connector including a plurality of pairs of plug signal contacts and a plurality of plug ground contacts, wherein each pair of plug signal contacts of the plurality of pairs of plug signal contacts and each plug ground contact of the plurality of plug ground contacts are arranged alternately, wherein:

respective contacts of each pair of jack signal contacts come into contact with respective contacts of each pair of plug signal contacts, respectively, and each jack ground contact comes into contact with each plug ground contact, and the connector device has a ground contact common connecting part configured to electrically connect all of the plurality of jack ground contacts together at a position near to an extending end of each of the plurality of jack ground contacts.

6. A jack connector comprising:

a plurality of pairs of signal contacts and a plurality of ground contacts each being sheet-shaped, wherein the plurality of pairs of jack signal contacts an the plurality of jack ground contacts each being sheet-shaped are built into an electrically insulating jack block member in such a manner that each pair of jack signal contacts of the plurality of pairs of jack signal contacts and each jack ground contact of the plurality of jack ground contacts are arranged alternately, wherein:

respective edge parts of the plurality of jack ground contacts extend from the electrically insulating jack block member, and all of the respective edge parts of the plurality of jack ground contacts are electrically connected together by means of an electrical common connecting member;

wherein the first and second electrical common connecting members are electrically conductive and elastic gaskets, and the electrically conductive and elastic gaskets are pressed by an inner surface of a case which encloses the jack block member, and are elastically in contact with the respective upper edge parts and the respective lower end parts of the plurality of jack contacts, respectively.

7. The jack connector as claimed in claim 6, wherein:

both of respective upper edge parts and respective lower edge parts of the plurality of jack ground contacts are exposed from the electrically insulating jack block member, and all of the respective upper edge parts of the plurality of jack ground contacts are electrically connected together by means of a first electrical common connecting member, and all of the respective lower edge parts of the plurality of jack ground contacts are electrically connected together by means of a second electrical common connecting member.

8. A connector device, comprising:

a jack connector including a plurality of pairs of jack signal contacts and a plurality of jack ground contacts, wherein each pair of jack signal contacts of the plurality of pairs of jack signal contacts and each jack ground contact of the plurality of jack ground contacts are arranged alternately; and a plug connector including a plurality of pairs of plug signal contacts and a plurality of plug ground contacts, wherein each pair of plug signal contacts of the plurality of pairs of plug signal contacts and each plug ground contact of the plurality of plug ground contacts are arranged alternately, wherein:

respective contacts of each pair of jack signal contacts come into contact with respective contacts of each pair of plug signal contacts, and each jack ground contact comes into contact with each plug ground contact, and the connector device has:

a first contact structure in which each jack ground contact comes into contact with each plug ground contact at a first position;

a second contact structure in which each jack ground contact comes into contact with each plug ground contact at a second position apart from the first position along an extending direction of the plug ground contact; and a ground contact common connecting part configured to electrically connect all of the plurality of jack ground contacts together at a position near to an extending end of each of the plurality of jack ground contacts.

* * * * *